US009855997B1

(12) United States Patent
Yeh

(10) Patent No.: US 9,855,997 B1
(45) Date of Patent: Jan. 2, 2018

(54) FOAM PRODUCT

(71) Applicant: AGIT Global IP Holdings, LLC, Irvine, CA (US)

(72) Inventor: Tzong In Yeh, Fremont, CA (US)

(73) Assignee: Agit Global IP Holdings, LLC, Irvine, CA (US)

( * ) Notice: Subject to any disclaimer, the term of this patent is extended or adjusted under 35 U.S.C. 154(b) by 0 days.

(21) Appl. No.: 15/249,902

(22) Filed: Aug. 29, 2016

(51) Int. Cl.

| | |
|---|---|
| ***B63B 5/24*** | (2006.01) |
| ***B63B 35/71*** | (2006.01) |
| ***A63C 5/12*** | (2006.01) |
| ***A63C 17/01*** | (2006.01) |
| ***B63B 35/79*** | (2006.01) |
| *B63B 35/00* | (2006.01) |

(52) U.S. Cl.
CPC ..... *B63B 5/24* (2013.01); *A63C 5/126* (2013.01); *A63C 17/017* (2013.01); *B63B 35/71* (2013.01); *B63B 35/7909* (2013.01); *B63B 2035/009* (2013.01)

(58) Field of Classification Search
CPC ..... B63B 5/24; B63B 35/71; B63B 35/7909; A63C 17/017; A63C 5/126
See application file for complete search history.

(56) References Cited

U.S. PATENT DOCUMENTS 3,338,203 A * 8/1967 Moore ..... B63B 1/18 114/271
3,707,401 A * 12/1972 Jarema et al. ..... B63B 35/7906 428/307.3
3,839,080 A * 10/1974 Jarema ..... B63B 35/7906 428/307.3
9,120,218 B1 * 9/2015 Stehlik ..... B25G 1/10
2004/0149197 A1 * 8/2004 Maklezow ..... B63B 5/24 114/360
2007/0155261 A1 * 7/2007 Cheung ..... B63B 13/00 441/65
2008/0032575 A1 * 2/2008 Wyrsta ..... B63B 35/7909 441/74
2013/0115399 A1 * 5/2013 Roberts ..... B29C 45/1615 428/36.5
2013/0257069 A1 * 10/2013 Roberts ..... B60R 19/22 293/120
2013/0260080 A1 * 10/2013 Roberts ..... B29C 44/08 428/71
2014/0315453 A1 10/2014 Brouwer et al.
2015/0064379 A1 * 3/2015 Roberts ..... B29C 49/04 428/36.5
2015/0118426 A1 * 4/2015 Roberts ..... B29C 44/18 428/36.4
2015/0196809 A1 * 7/2015 Sullivan ..... A63B 37/0058 473/376

* cited by examiner

*Primary Examiner* — Stephen P Avila
(74) *Attorney, Agent, or Firm* — Muncy, Geissler, Olds & Lowe, P.C.

(57) ABSTRACT

A foam product includes a foam core and a soft shell. The foam core includes a tightly packed cluster of expanded beads. Each of the expanded beads is made of a pre-expanded bead. The foam core defines in its top surface a recess. The recess has an inner wall on which some outermost beads of the expanded beads are exposed and protruded. The soft shell is disposed within the recess of the foam core and has an outer wall attached to the inner wall of the recess. In particular, the soft shell has at its outer wall a plurality of cavities sized and shaped to respectively receive the protruded, outermost beads in the recess of the foam core.

17 Claims, 17 Drawing Sheets

FOAM PRODUCT

BACKGROUND OF THE INVENTION

1. Field of the Invention

The present invention relates to a foam product, and more particularly to a closed-cell foam product.

2. Description of the Related Art

Nowadays, if a foam product is too wide to be carried under the arm, such as a standup paddle board, it may employ a recessed grip handle structure so that a user may have the fingers of a hand be inserted into the grip handle structure to carry the paddle board under the One type of standup paddle board is illustrated in U.S. Pat. No. 9,120,218. In this paddle board, the grip handle structure is constructed from a rigid plastic material, such as Nylon® fiber and installed flush into the deck of the paddle board at the center of gravity of the board to provide the proper balance when the board is carried using the grip handle. More specifically, the grip handle structure is glued to the foam core of the paddle board using an epoxy resin glue.

Another type of standup paddle board is illustrated in U.S. Patent Pub. NO. 2014/0315453. In this paddle board, a recess is defined in a top surface of the foam core of the paddle board, and an upper foam skin covers the top surface of the foam core. In particular, a portion of the upper foam skin extends along the profile of the recess in the foam core to form a grip handle structure for carrying the paddle board.

SUMMARY OF THE INVENTION

This invention provides a new foam product with a different structure as compared to the convention foam product.

In one aspect, the foam product of this invention includes a foam core and a soft shell. The foam core includes a tightly packed cluster of expanded beads. Each of the expanded beads is made of a pre-expanded bead. The foam core defines in its top surface a recess. The recess has an inner wall on which some outermost beads of the expanded beads are exposed and protruded. The soft shell is disposed within the recess of the foam core and has an outer wall attached to the inner wall of the recess. In particular, the soft shell has at its outer wall a plurality of cavities sized and shaped to respectively receive the protruded, outermost beads in the recess of the foam core.

In another aspect, the foam product of this invention includes a foam core and a foam skin. The foam core includes a tightly packed cluster of expanded beads. Each of the expanded beads is made of a pre-expanded bead. The foam core has an outer surface on which some outermost beads of the expanded beads are exposed and protruded. The foam skin has an inner surface attached to the outer surface of the recess. In particular, the foam skin has at its inner surface a plurality of cavities sized and shaped to respectively receive the protruded, outermost beads on the outer surface of the foam core.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 12A is an enlarged view of the foam product shown in FIG. 12;

DETAILED DESCRIPTION OF EMBODIMENTS

Figure 1:
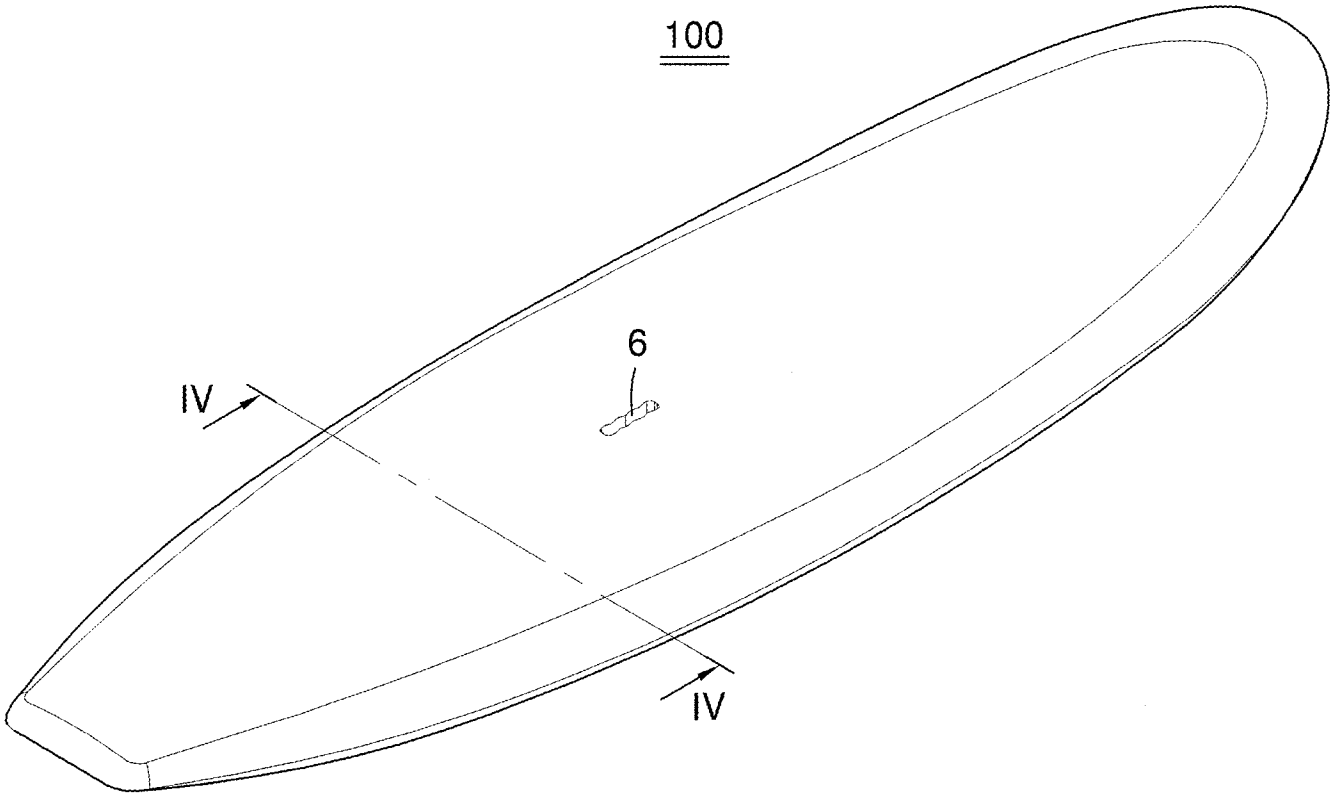
FIG. 1 is a perspective view of a foam product in accordance with a first embodiment of the present invention.
Figure 2:
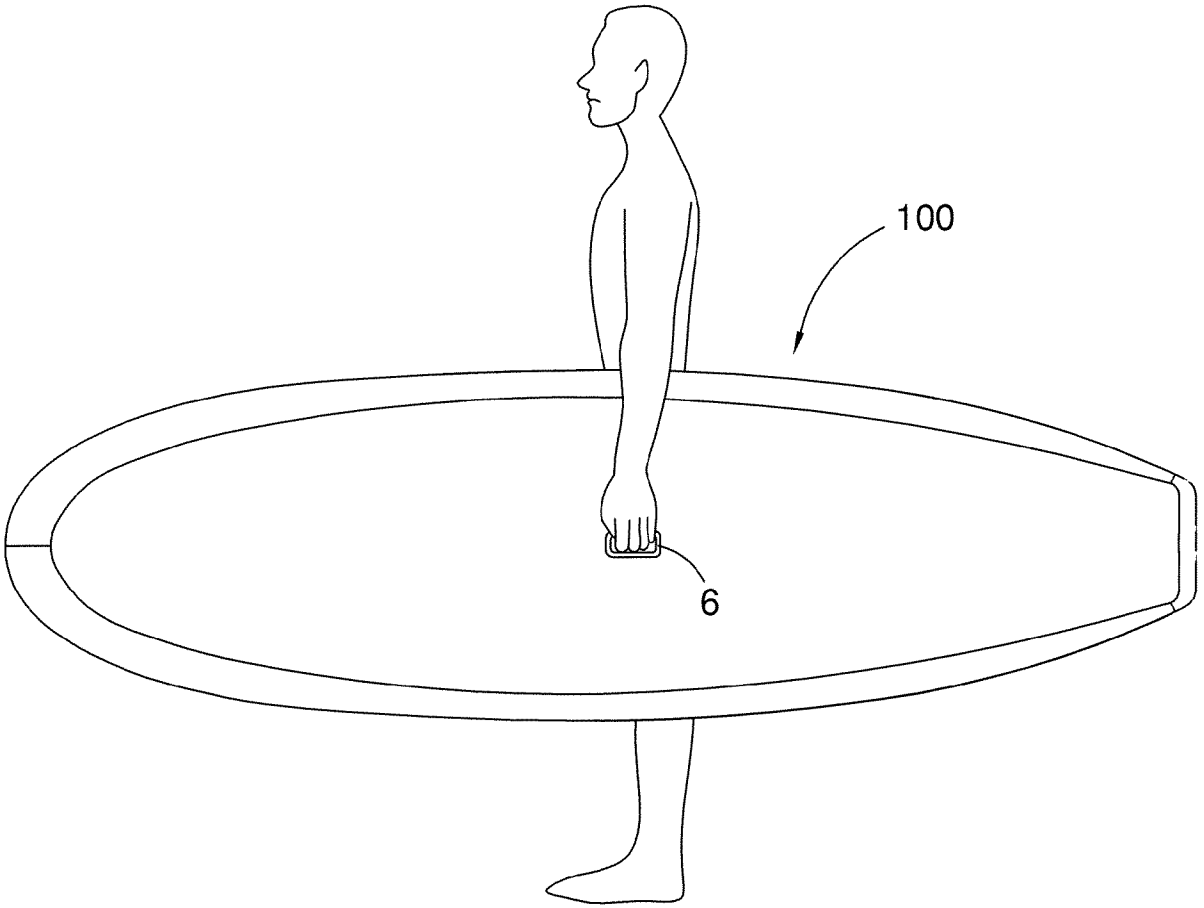
FIG. 2 illustrates that the foam product shown in FIG. 1 is carried by a user.
Figure 3:
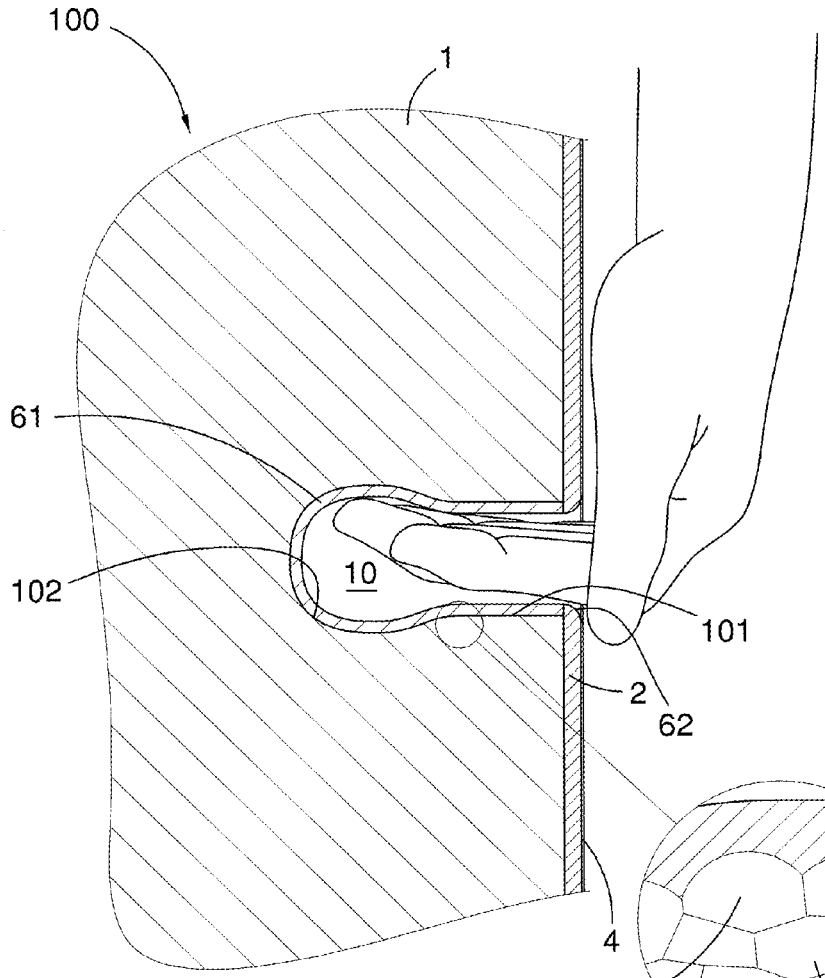
FIG. 3 is a partial cross-sectional view of the foam product shown in FIG. 1, showing that fingers of a hand are inserted into a recessed grip handle structure of the foam product.

Referring to FIGS. 1-6, there is shown a first embodiment of the foam product 100 according to the invention. The foam product 100 is a standup paddle board with a grip handle structure 6. A user can easily hold the foam product 100 using the grip handle structure 6 under the arm for transporting the foam product 100 in a comfortable and secure manner, as depicted in FIGS. 2 and 3.

Figure 4:
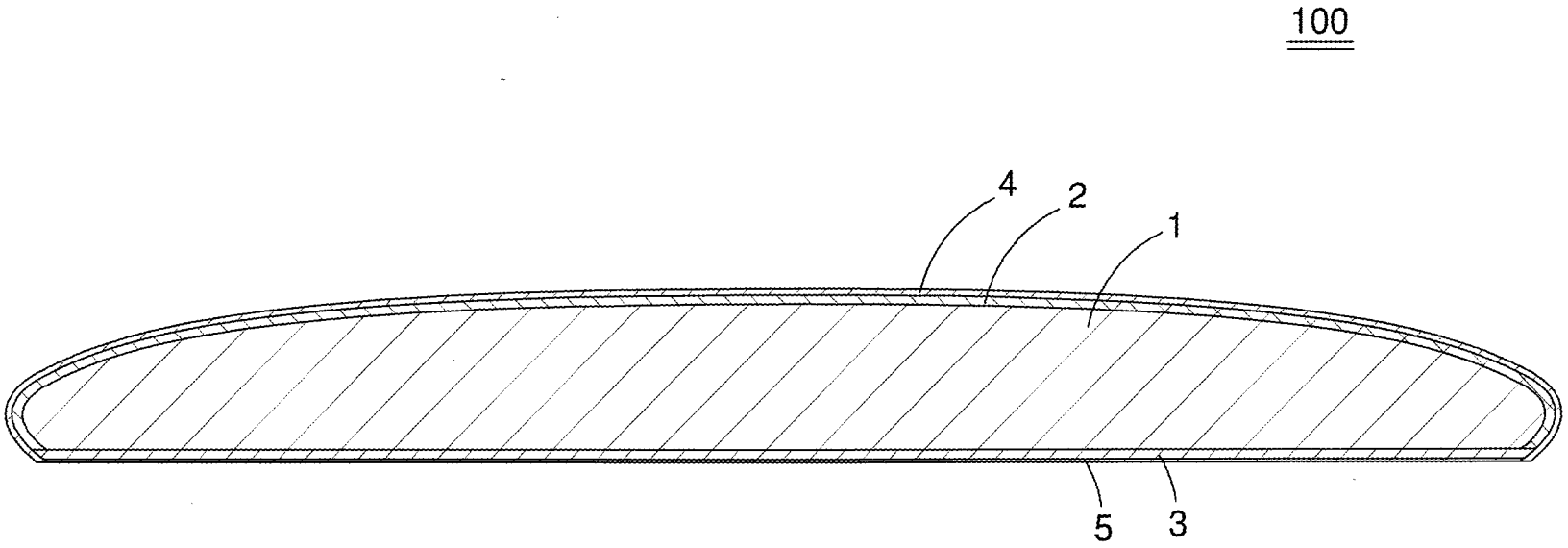
FIG. 4 is a cross-sectional view of the foam product shown in FIG. 1 taken along the line IV-IV.

As shown in FIG. 4, the foam product 100 further includes a foam core 1, an upper foam skin 2 and a lower foam skin 3. In this embodiment, the upper foam skin 2 is shaped like a half-shell and has a bottom surface glued to a top surface as well as side surfaces of the foam core 1. The lower foam skin 3 has a top surface glued to a bottom surface of the foam core 1. The foam core 1 is made of expanded polystyrene (EPS). The upper foam skin 2 and the lower foam skin 3 are both made of a relative softer material, such as expanded polyethylene (EPE) and each has a thickness of about 4 mm to 5 mm. The foam product 100 further includes a non-foam plastic film 4 and a non-foam plastic plate 5 for protection. The non-foam plastic film 4 has a bottom surface directly heat-laminated to the top surface of the upper foam skin 2. The non-foam plastic film 4 may be colored or include a pattern visible from the outside of the film 4. On the other hand, the non-foam plastic plate 5 is directly heat-laminated to the bottom surface of the lower foam skin 3. And, the non-foam plastic plate 5 is made of a wear-resistant material, such as polyethylene (PE). Referring back to FIG. 3, the grip handle structure 6 includes a soft shell 61 and an opening 62 extending through the upper foam skin 2 and the non-foam plastic film 4. The soft shell 61 is preferably made of an irradiated cross-linked polyethylene foam, with a thickness of about 2 mm to 3 mm.

Figure 5:
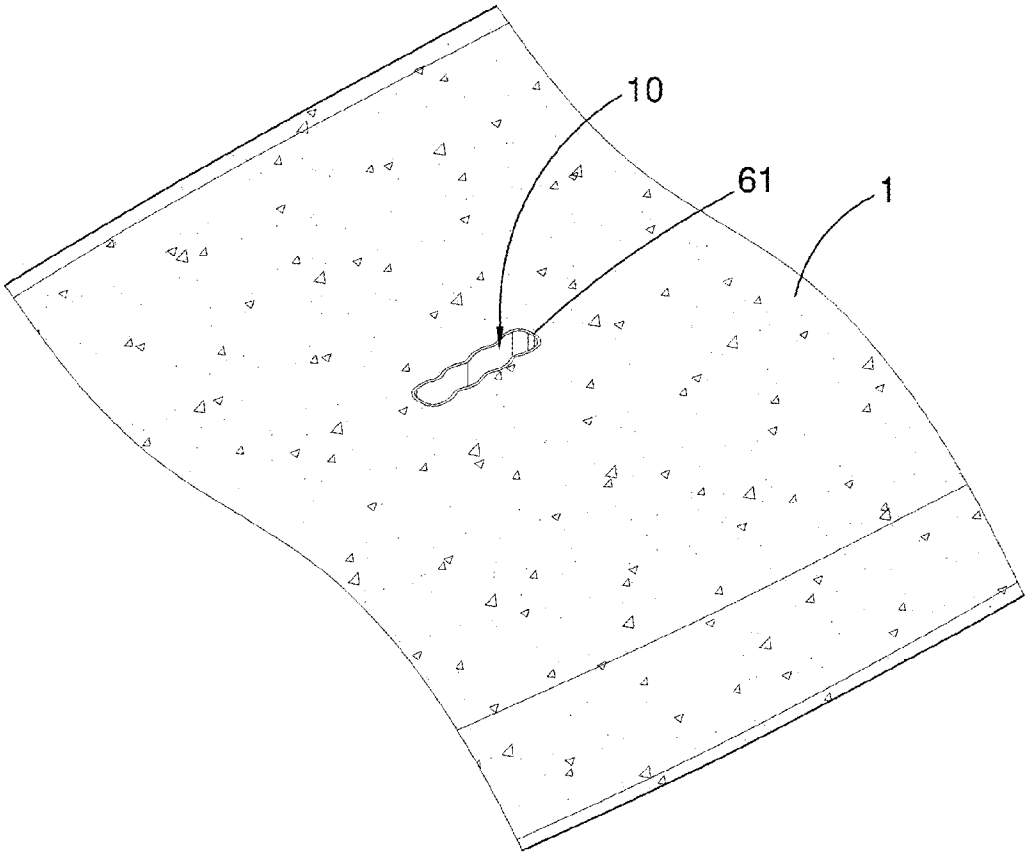
FIG. 5 is a perspective view of a foam core and a soft shell of the foam product shown in FIG. 1.
Figures 6, 6A:
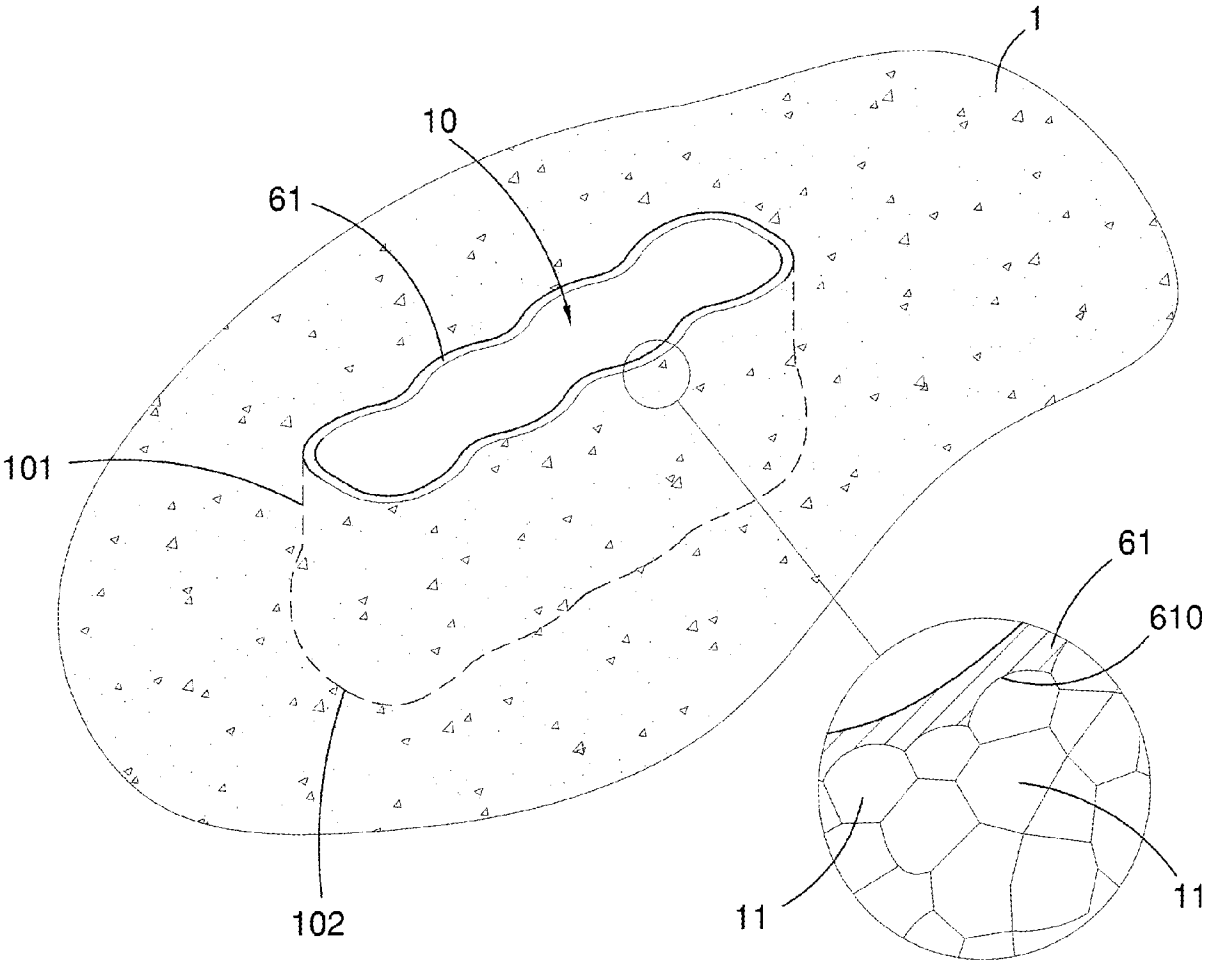
FIG. 6 is an enlarged view of the foam product shown in FIG. 5.
FIG. 6A is an enlarged view of the foam product shown in FIG. 6.
Figure 7:
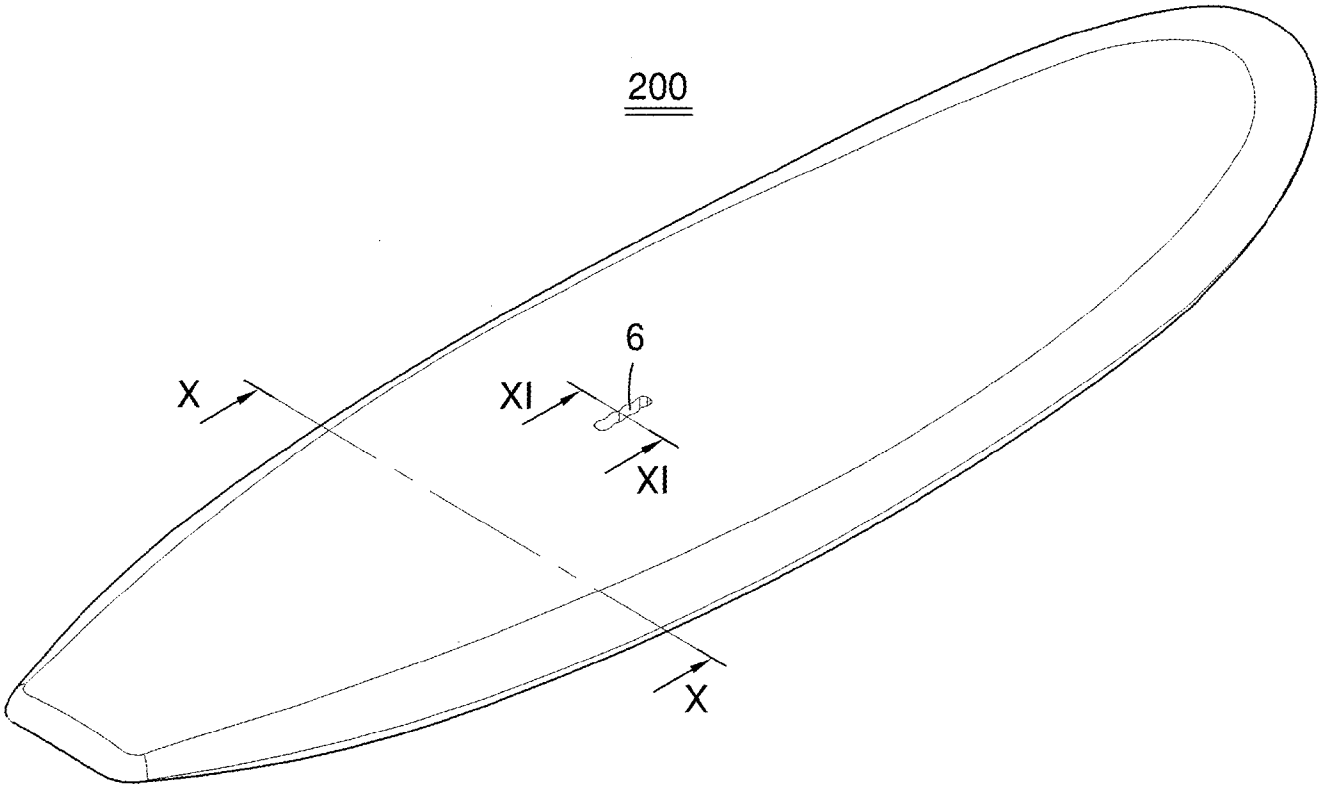
FIG. 7 is a perspective view of a foam product in accordance with a second embodiment of the present invention.

FIG. 5 illustrates the foam core 1 with a recess 10 in which the soft shell 61 is disposed. As shown in FIGS. 6 and 6A, the foam core 1 includes a tightly packed cluster of expanded beads 11. Each of the expanded beads 11 is made of a pre-expanded polystyrene bead. The foam core 1 defines the recess 10 in its top surface. The recess 10 has an upper space 101 and a lower, enlarged space 102. The soft shell 61 is suited in the recess 10 of the foam core 1 and has an upper space (not numbered) configured in size to receive four fingers of a human hand, and a lower, enlarged space (not numbered) to permit bending of the fingers, as shown in FIG. 3, as well.

Figure 3A:
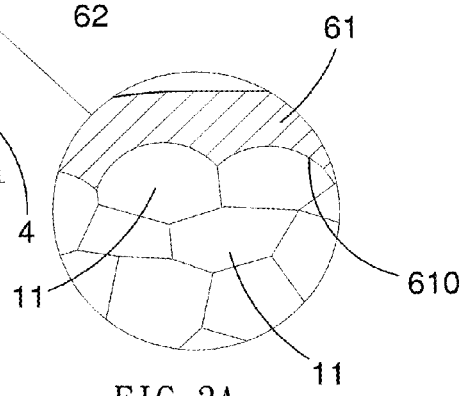
FIG. 3A is an enlarged view of the foam product shown in FIG. 3.

It is noted that, some outermost beads 11 of the expanded beads 11 are exposed and protruded on the inner wall of the recess 10 of the foam core 1. The soft shell 61 has its outer wall attached to the inner wall of the recess 10 of the foam core 1. More specifically, as shown in FIGS. 3A and 6A, the soft shell 61 has a plurality of cavities 610 at its outer wall. The cavities 610 of the soft shell 61 are sized and shaped to respectively receive the protruded, outermost beads 11 in the recess 10 of the foam core 1. In contrast, the inner wall of the soft shell 61 is relatively more flat than the outer wall of the soft shell 61. In other words, the cavities 610 are defined only in the outer wall of the soft shell 61, not the inner wall of the soft shell 61. The soft shell 61 and the foam core 1 are firmly bonded together due to the inter-engaged convex and concave surfaces between the soft shell 61 and the foam core 1. Besides, it should be noted that the soft shell 61 and the foam core 1 may be directly heat bonded to each other with similar materials. Alternatively, an adhesive may be employed in between the soft shell 61 and the foam core 1 to further enhance the bonding between the two.

Referring to FIGS. 7-11, there is shown a second embodiment of the foam product 200 according to the invention. The foam product 200 of the second embodiment is generally identical to the foam product 100 of the first embodiment in appearance, and has a grip handle structure 6 for being grasped. However, the foam product 200 is slightly different from the foam product 100 in the interior structure. For example, the foam core 1 of the foam product 100 is made of a single foam body with the same material; however, the foam product 200 is a combination of two foam bodies with different materials and densities.

Figure 8:
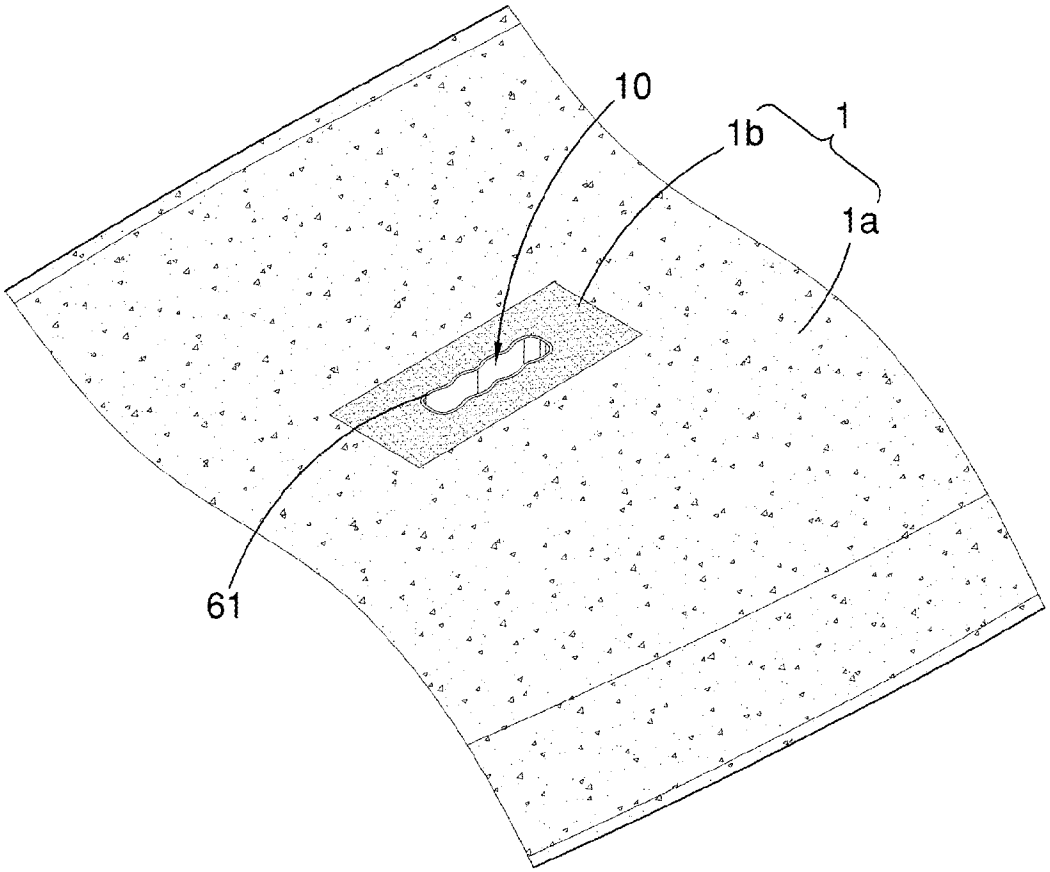
FIG. 8 is a perspective view of a foam core and a soft shell of the foam product shown in FIG. 7.
Figures 9, 9A:
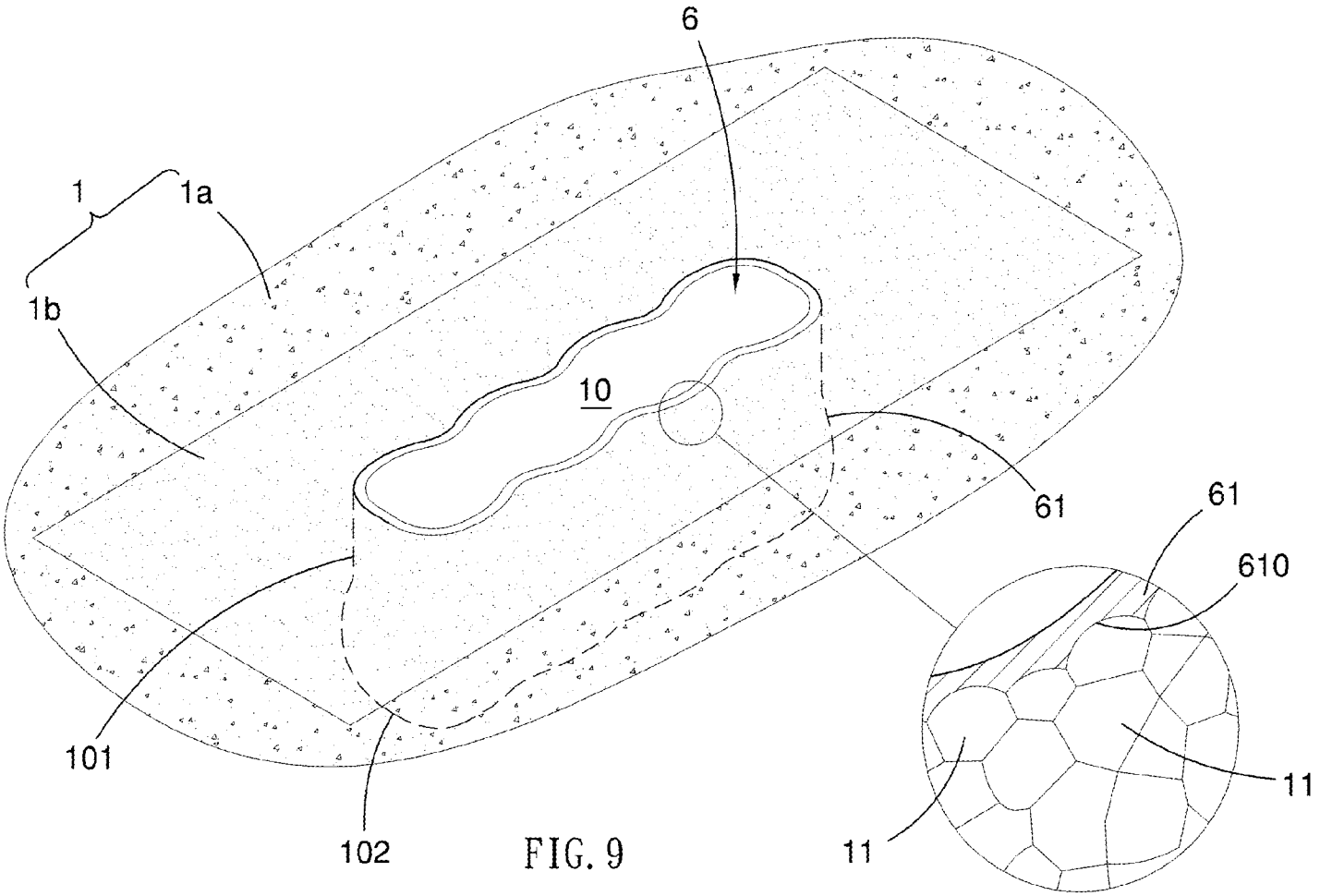
FIG. 9 is an enlarged view of the foam product shown in FIG. 8.
FIG. 9A is an enlarged view of the foam product shown in FIG. 9.

FIG. 8 illustrates a perspective view of the foam core 1 and the soft shell 61 of the foam product 200. As shown, the foam core 1 includes a first foam body 1*a* and a second foam body 1*b* embedded in the first foam body 1*a*. Specifically, the second foam body 1*b* is more rigid than the first foam body 1*a*. The recess 10 is defined in the second foam body 1*b* of the foam core 1. The first foam body 1*a* is made of expanded polystyrene, and the second foam body 1*b* is made of a copolymer of expanded polystyrene and expanded polyethylene. As best seen in FIG. 9, the recess 10 has an upper space 101 and a lower, enlarged space 102. The soft shell 61 is suited in the recess 10 of the second foam body 1*b* of the foam core 1, and has an upper space (not numbered) configured in size to receive four fingers of a human hand, and a lower, enlarged space (not numbered) to permit bending of the fingers, as shown in FIG. 9.

Figure 10:
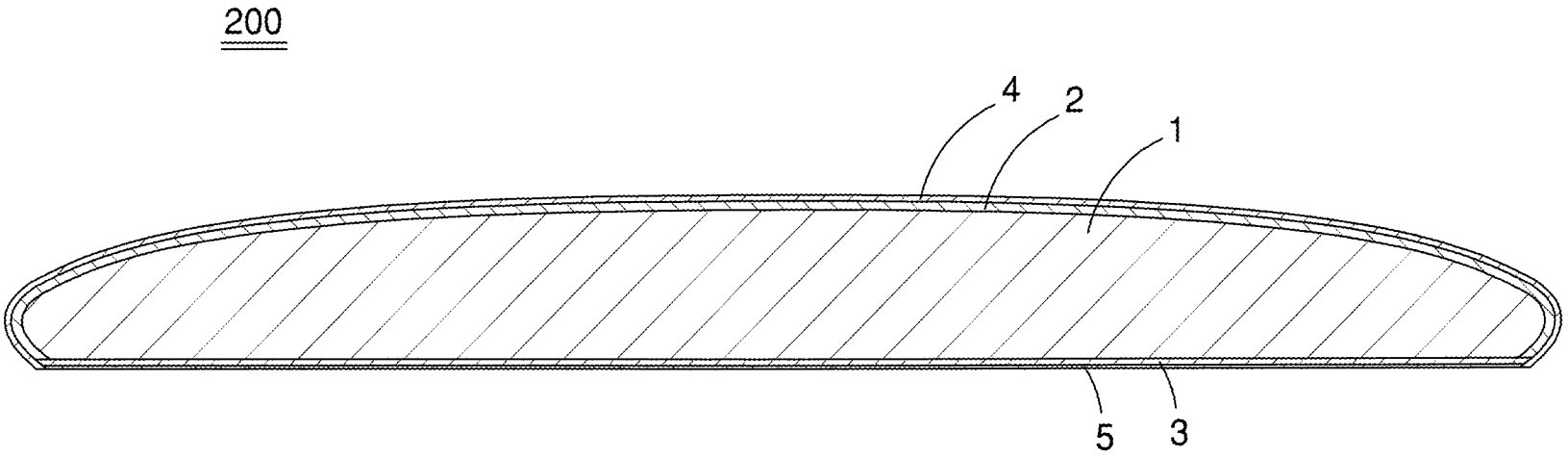
FIG. 10 is a cross-sectional view of the foam product shown in FIG. 7 taken along the line X-X.
Figures 11, 11A:
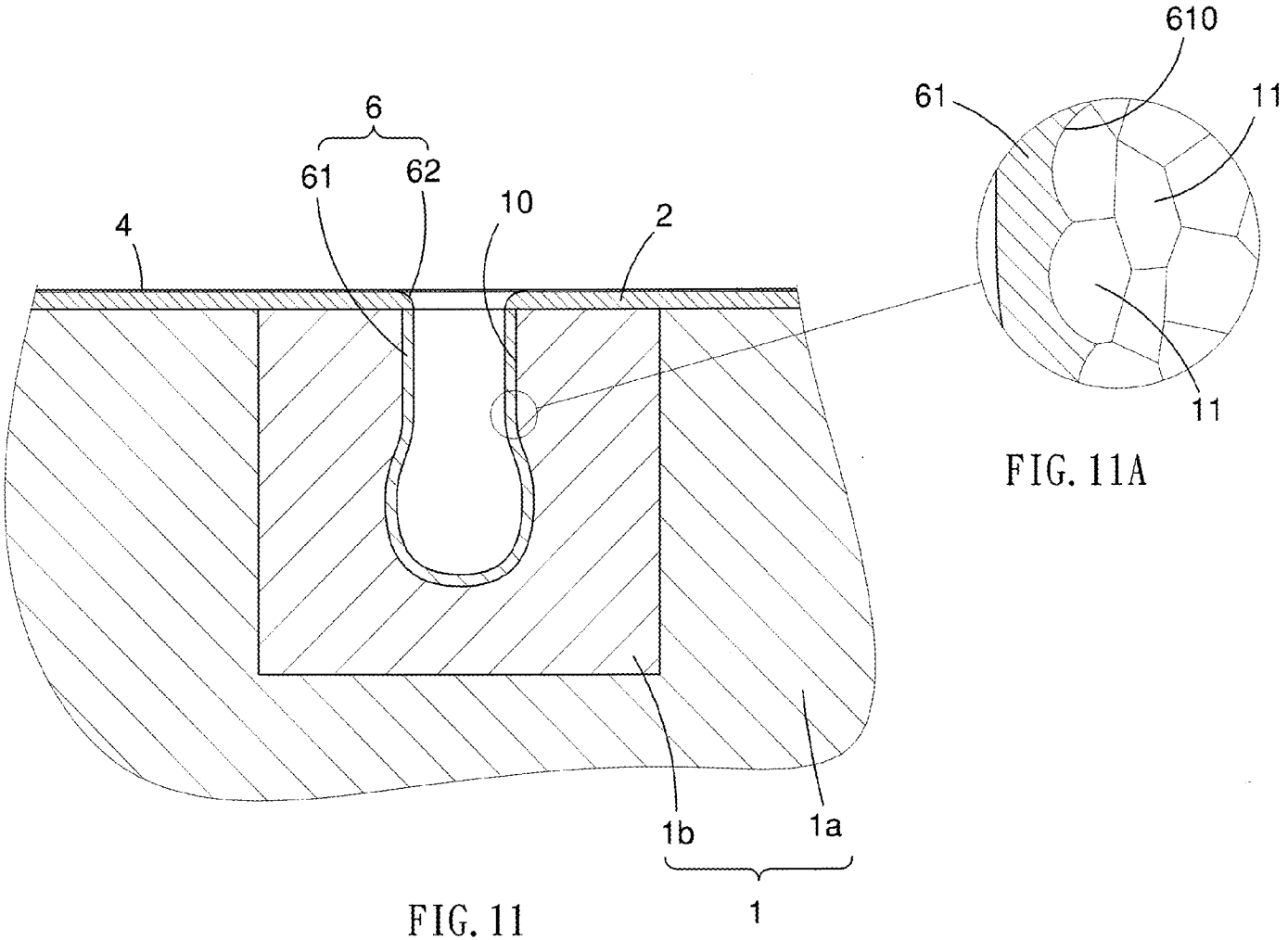
FIG. 11 is a cross-sectional view of the foam product shown in FIG. 7 taken along the line XI-XI.
FIG. 11A is an enlarged view of the foam product shown in FIG. 11.

As shown in FIG. 10, the foam product 200 further includes an upper foam skin 2 and a lower foam skin 3. The upper foam skin 2 is shaped like a half-shell and has a bottom surface glued to a top surface as well as side surfaces of the foam core 1. The lower foam skin 3 has a top surface glued to a bottom surface of the foam core 1. The upper foam skin 2 and the lower foam skin 3 are both made of a relative softer material, such as expanded polyethylene (EPE) and each has a thickness of about 4 mm to 5 mm. The foam product 200 further includes a non-foam plastic film 4 and a non-foam plastic plate 5 for protection. The non-foam plastic film 4 has a bottom surface directly heat-laminated to the top surface of the upper foam skin 2. And, the non-foam plastic film 4 may be colored or include a pattern visible from the outside of the film 4. The non-foam plastic plate 5 is directly heat-laminated to the bottom surface of the lower foam skin 3. And, the non-foam plastic plate 5 is made of a wear-resistant material, such as polyethylene (PE). As shown in FIG. 11, the grip handle structure 6 includes a soft shell 61 and an opening 62 extending through the upper foam skin 2 and the non-foam plastic film 4. The soft shell 61 is preferably made of an irradiated cross-linked polyethylene foam, with a thickness of about 2 mm to 3 mm.

Referring back to FIGS. 9 and 9A, the second foam body 1*b* of the foam core 1 includes a tightly packed cluster of expanded beads 11. Each of the expanded beads 11 is made of a pre-expanded bead. Similarly, the first foam body 1*a* of the foam core 1 is made of a tightly packed cluster of expanded beads 11, not shown, but with a different material. As shown in FIGS. 11 and 11A, some outermost beads 11 of the expanded beads 11 are exposed and protruded on the inner wall of the recess 10 of the second foam body 1*b*. The soft shell 61 has its outer wall attached to the inner wall of the recess 10 of the foam core 1. More specifically, the soft shell 61 has a plurality of cavities 610 at its outer wall. The cavities 610 of the soft shell 61 are sized and shaped to respectively receive the protruded, outermost beads 11 in the recess 10 of the second foam body 1*b*. In contrast, the inner wall of the soft shell 61 is relatively more flat than the outer wall of the soft shell 61. In this manner, the soft shell 61 and the second foam body 1*b* are firmly bonded together due to the inter-engaged convex and concave surfaces between the soft shell 61 and the second foam body 1*b*. It should be noted that the soft shell 61 and the second foam body 1*b* may be directly heat bonded to each other with similar materials. Alternatively, an adhesive may further be employed to further enhance the bonding of the soft shell 61 and the second foam body 1*b*.

Figure 12:
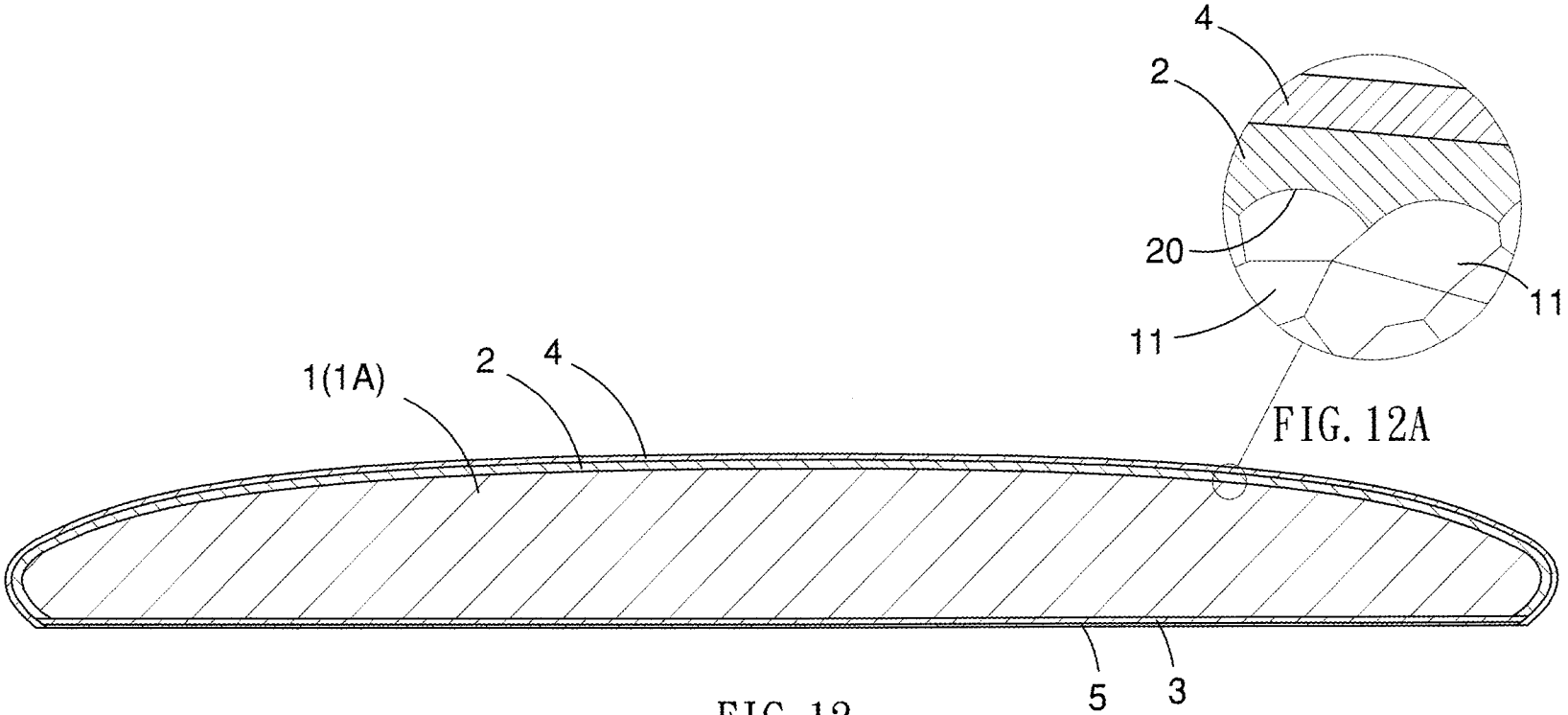
FIG. 12 is a cross-sectional view of a foam product in accordance with a third embodiment of the present invention.
Figure 13A:
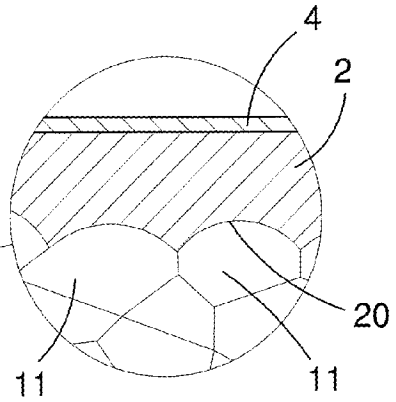
FIG. 13A is an enlarged view of the foam product shown in FIG. 13.
Figure 13B:
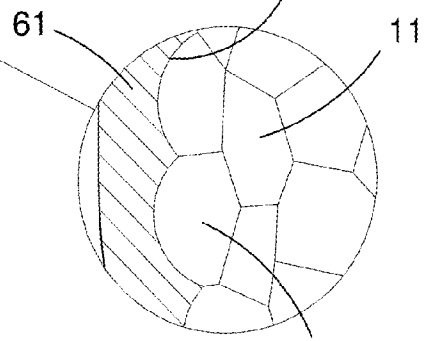
FIG. 13B is another enlarged view of the foam product shown in FIG. 13.
Figure 13:
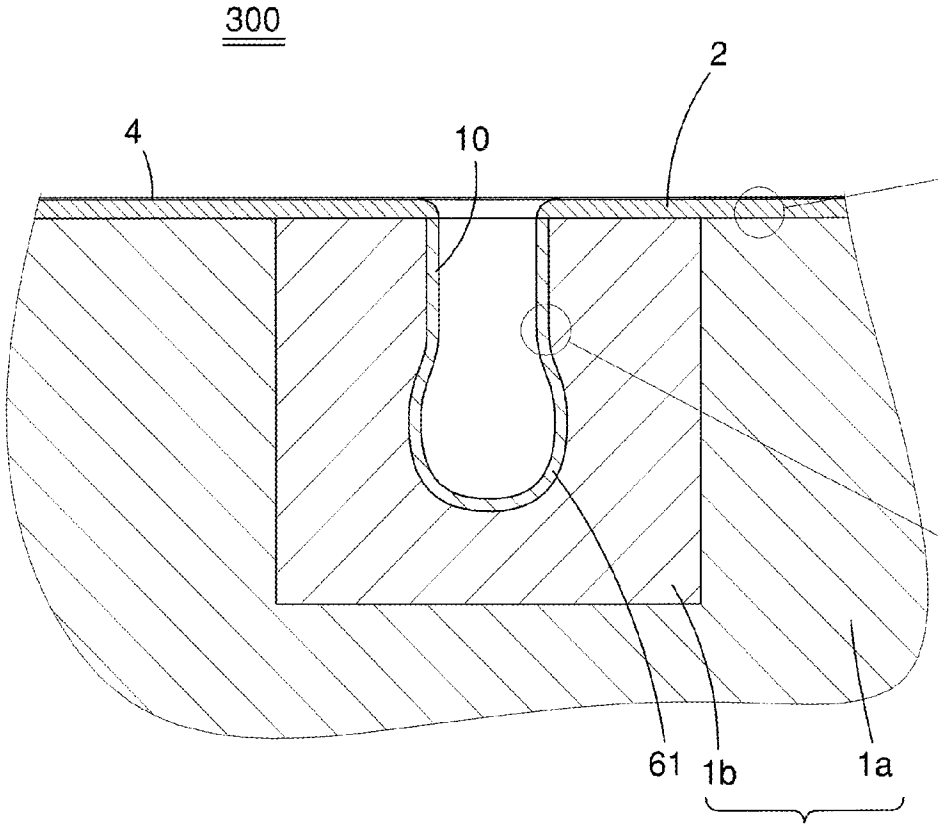
FIG. 13 is another cross-sectional view of the foam product shown in FIG. 12.

Referring to FIGS. 12-13, there is shown a third embodiment of the foam product 300 according to the invention. The foam product 300 of the third embodiment is generally identical to the foam product 200 of the second embodiment in appearance and in structure. For example, the foam core 1 of the foam product 300 also includes a first foam body 1*a* and a second foam body 1*b*. However, the foam core 1 and the upper foam skin 2 of the foam product 300 are bonded in a different manner.

As shown in FIGS. 12 and 12A, some outermost beads 11 of the expanded beads are exposed and protruded on the top surface of the first foam body 1*a* of the foam core 1. Referring to FIG. 13, the upper foam skin 2 has at its bottom surface a plurality of cavities 20 sized and shaped to respectively receive the protruded, outermost beads 11 on the top surface of the first foam body 1*a*, except that a small area of the bottom surface of the upper foam skin 2 is adhered to the top surface of the second foam body 1*b*. In other words, the upper foam skin 2 is partly bonded to the second foam body 1*b* via adhesives, and is mostly bonded to the first foam body 1*a* via the inter-engaged convex and concave surfaces, as shown in FIG. 13A. Likewise, the soft shell 61 is bonded to the second foam body 1*b* via the inter-engaged convex and concave surfaces, as shown in FIG. 13B.

Figures 14, 14A, 14B:
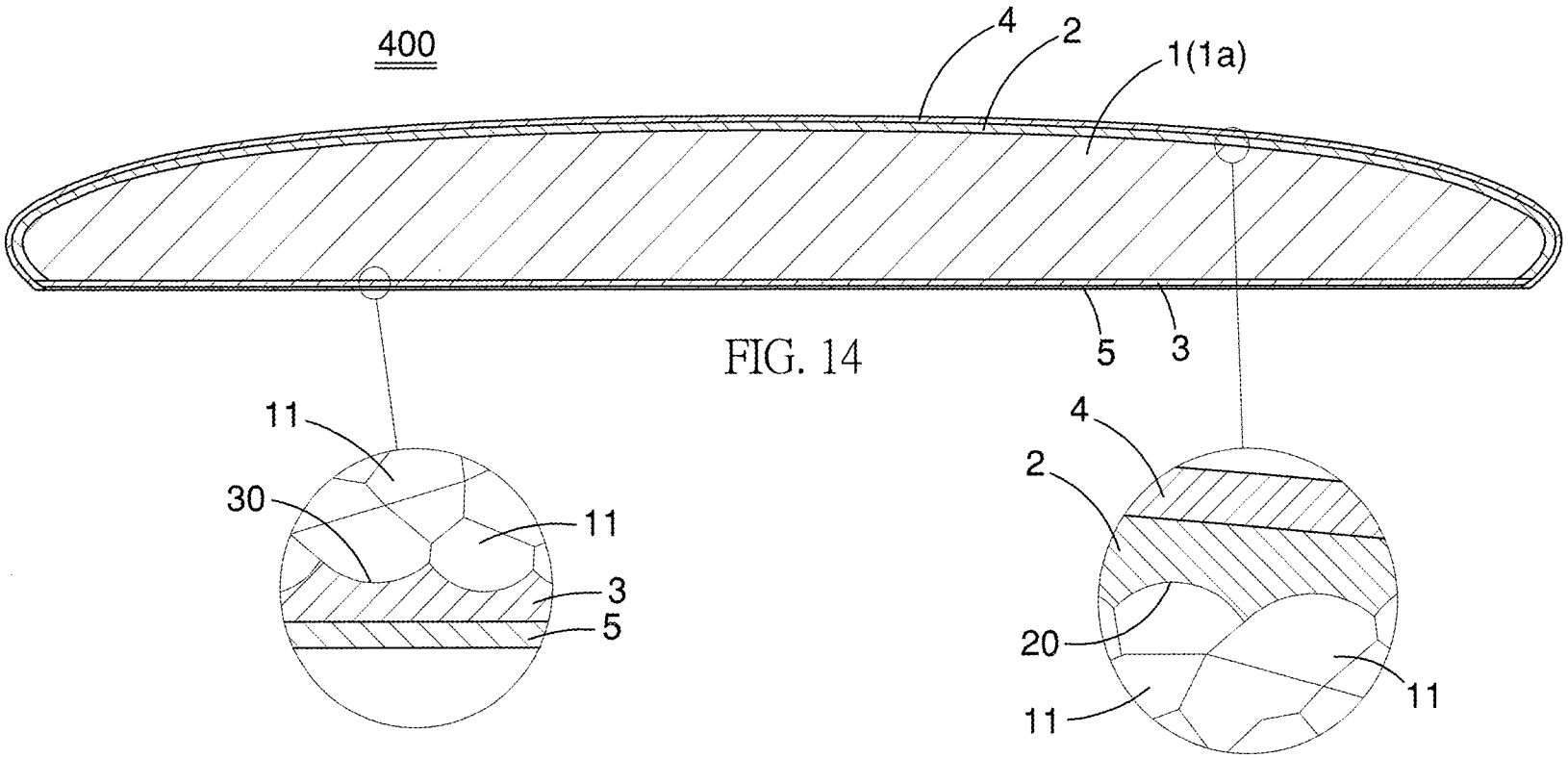
FIG. 14 is a cross-sectional view of a foam product in accordance with a fourth embodiment of the present invention.
FIG. 14A is an enlarged view of the foam product shown in FIG. 14.
FIG. 14B is another enlarged view of the foam product shown in FIG. 14.

Referring to FIGS. 14, 14A and 14B, there is shown a fourth embodiment of the foam product 400 according to the invention. The foam product 400 of the fourth embodiment is generally identical to the foam product 300 of the third embodiment. For example, the foam core 1 of the foam product 400 includes a first foam body 1*a* and a second foam body (not shown); and the upper foam skin 2 is bonded to the first foam body 1*a* via the inter-engaged convex and concave surfaces, as shown in FIG. 14B. However, as shown in FIG. 14A, the foam core 1 and the lower foam skin 3 of the foam product 400 are bonded in a different manner.

As shown in FIG. 14A, some outermost beads 11 of the expanded beads are exposed and protruded on the bottom surface of the first foam body 1*a* of the foam core 1. The lower foam skin 3 has at its top surface a plurality of cavities 30 sized and shaped to respectively receive the protruded, outermost beads 11 on the bottom surface of the first foam body 1*a*. As such, the lower foam skin 3 is firmly bonded to the first foam body 1*a* via the inter-engaged convex and concave surfaces as well.

Figure 15:
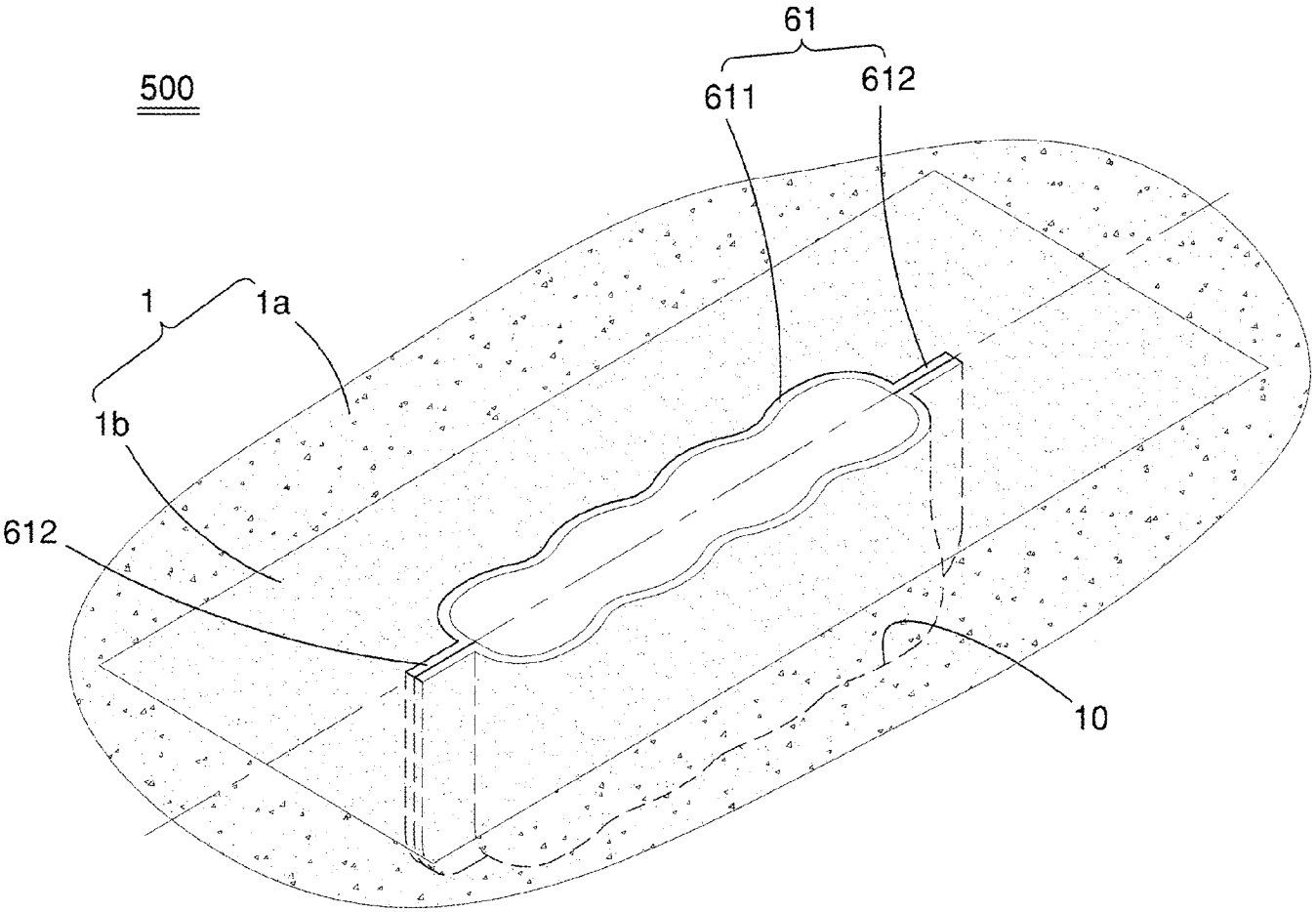
FIG. 15 is a perspective view of a foam core and a soft shell of a foam product in accordance with a fifth embodiment of the present invention.

Referring to FIG. 15, there is shown a fifth embodiment of the foam product 500 according to the invention. The foam product 500 of the fifth embodiment is generally identical to the foam product 300 of the third embodiment. For example, the foam core 1 of the foam product 500 includes a first foam body 1*a* and a second foam body 1*b*; and the upper foam skin 1 is bonded to the first foam body 1*a* via the inter-engaged convex and concave surfaces. However, the soft shell 61 of the foam product 500 is slightly different from that of the foam product 300.

As shown in FIG. 15, the soft shell 61 includes a shell body 611 and a pair of extensions 612 extending from opposite sides of the shell body 611. Each of the extensions 612 has two sheets (not numbered) attached to each other. The recess 10 of the second foam body 1*b* of the foam core 1 is sized and shaped to receive the whole soft shell 61, namely both the shell body 611 and the extensions 612.

Figure 16:
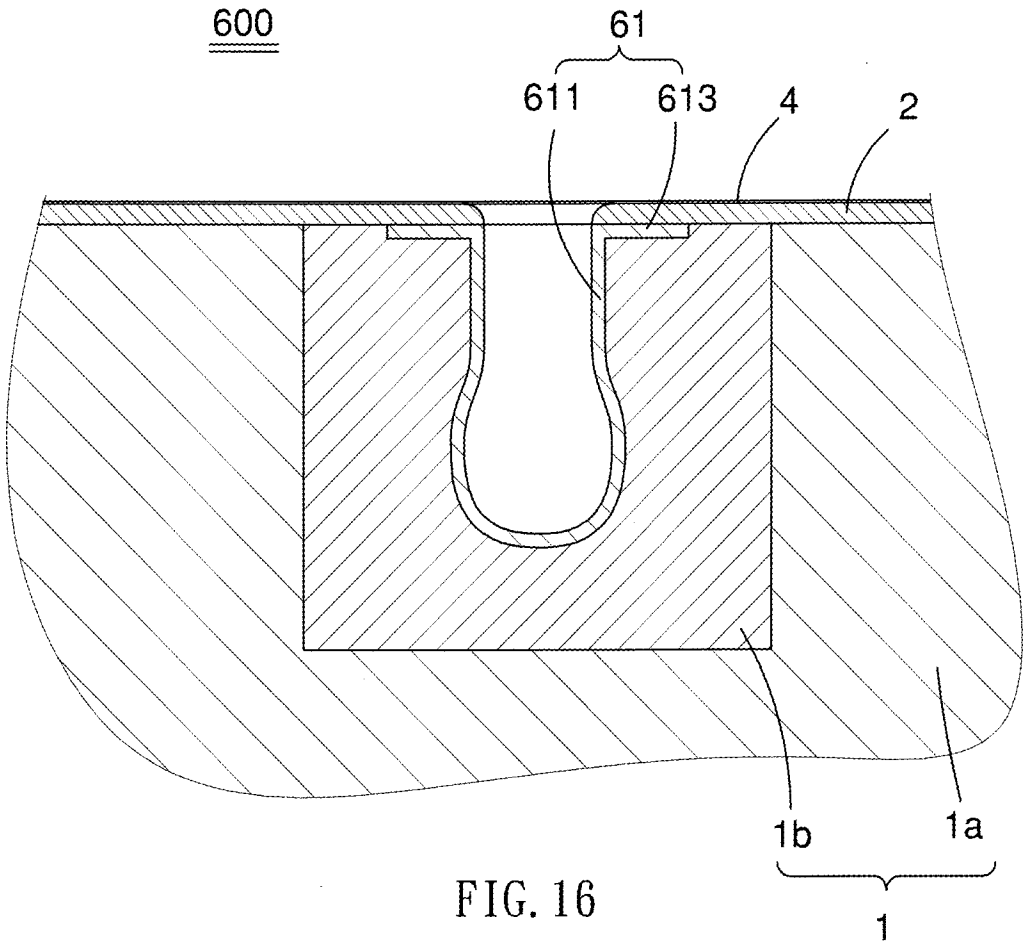
FIG. 16 is a partial cross-sectional view of a foam product in accordance with a sixth embodiment of the present invention.
Figure 17:
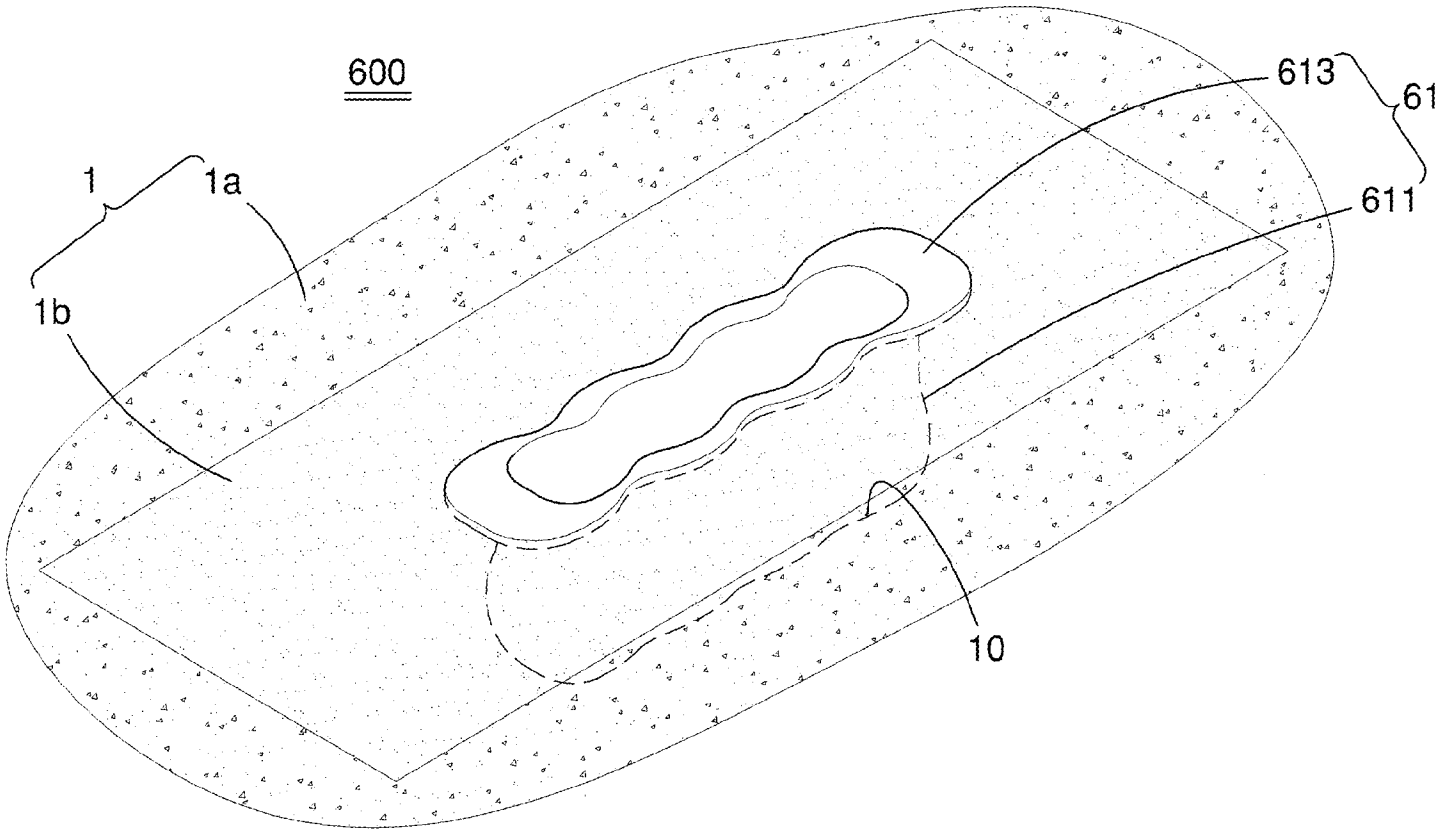
FIG. 17 is a perspective view of a foam core and a soft shell of the foam product shown in FIG. 16.

Referring to FIGS. 16 and 17, there is shown a sixth embodiment of the foam product 600 according to the invention. The foam product 600 of the sixth embodiment is generally identical to the foam product 300 of the third embodiment. For example, the foam core 1 of the foam product 600 includes a first foam body 1*a* and a second foam body 1*b*; and the upper foam skin 1 is bonded to the first foam body 1*a* via the inter-engaged convex and concave surfaces. However, the soft shell 61 of the foam product 600 is slightly different from that of the foam product 300.

As shown in FIG. 16 or 17, the soft shell 61 includes a shell body 611 and a flange 613 extending from a top edge of the shell body 611. The recess 10 of the second foam body 1*b* of the foam core 1 is sized and shaped to receive the whole soft shell 61, namely both the shell body 611 and the flange 613.

As described above, the present invention provides a foam product in which the soft shell and/or the foam skin may be thinly bonded to the foam core using the characteristic of the expanded beads of the foam core. The foam product may be one of a stand up paddle board, sit on top kayak, small sail boat, a windsurf board, a snow board, a skiing board, and other craft boards that are too wide to be carried under the arm. It is noted that the foam product is not limited to be shaped like a board or plate. Instead, the foam product would be non-flattened with a different shape.

It should be evident that this disclosure is by way of example and that various changes may be made by adding, modifying or eliminating details without departing from the fair scope of the teaching contained in this disclosure.

What is claimed is:

1. A foam product comprising:

a foam core including a tightly packed cluster of expanded beads, each of the expanded beads being made of a pre-expanded bead, the foam core defining in its top surface a recess, the recess having an inner wall on which some outermost beads of the expanded beads are exposed and protruded; and a soft shell disposed within the recess of the foam core and having an outer wall attached to the inner wall of the recess, wherein the soft shell has at its outer wall a plurality of cavities sized and shaped to respectively receive the protruded, outermost beads in the recess of the foam core.

2. A foam product as recited in claim 1, further comprising an upper foam skin with a bottom surface bonded to a top surface of the foam core, wherein some outermost beads of the expanded beads are exposed and protruded on the top surface of the foam core, and the upper foam skin has at its bottom surface a plurality of cavities sized and shaped to respectively receive the protruded, outermost beads on the top surface of the foam core.

3. A foam product as recited in claim 2, further comprising a lower foam skin with a top surface bonded to a bottom surface of the foam core, wherein some outermost beads of the expanded beads are exposed and protruded on the bottom surface of the foam core, and the lower foam skin has at its top surface a plurality of cavities sized and shaped to respectively receive the protruded, outermost beads on the bottom surface of the foam core.

4. A foam product as recited in claim 1, further comprising:

an upper foam skin with a bottom surface bonded to the top surface of the foam core;

a lower foam skin with a top surface bonded to a bottom surface of the foam core;

a non-foam plastic film with a bottom surface bonded to the top surface of the upper foam skin; and a non-foam plastic plate with a top surface bonded to a bottom surface of the lower foam skin.

5. A foam product as recited in claim 1, wherein the foam core include a first foam body and a second foam body disposed in the first foam body; the second foam body is more rigid than the first foam body; and the recess is defined in the second foam body of the foam core.

6. A foam product as recited in claim 5, wherein the first foam body of the foam core comprises expanded polystyrene, and the second foam body of the foam core comprises a copolymer of expanded polystyrene and expanded polyethylene.

7. A foam product as recited in claim 6, wherein the soft shell comprises a cross-linked polyethylene foam.

8. A foam product as recited in claim 7, wherein the cross-linked polyethylene foam of the soft shell is an irradiated cross-linked polyethylene foam.

9. A foam product as recited in claim 7, wherein the soft shell has a thickness of about 2 mm to 3 mm.

10. A foam product as recited in claim 1, wherein the soft shell has an upper space configured in size to receive at least one finger of a human hand, and a lower, enlarged space to permit bending of the finger.

11. A foam product as recited in claim 1, wherein the soft shell includes a shell body and a pair of extensions extending from opposite sides of the shell body, each of the extensions has two sheets attached to each other, and the recess of the foam core is sized and shaped to receive the soft shell.

12. A foam product as recited in claim 1, wherein the soft shell includes a shell body and a flange extending from a top edge of the shell body, and the recess of the foam core is sized and shaped to receive the soft shell.

13. The foam product as described in claim 1, wherein the foam product is one of a stand up paddle board, sit on top kayak, small sail boat, windsurf board, a snow board, and a skiing board.

14. A foam product comprising:

a foam core including a tightly packed cluster of expanded beads, each of the expanded beads being made of a pre-expanded bead, the foam core having an outer surface on which some outer most beads of the expanded beads are exposed and protruded; and a foam skin having an inner surface attached to the outer surface of the foam core, wherein the foam skin has at its inner surface a plurality of cavities sized and shaped to respectively receive the protruded, outermost beads on the outer surface of the foam core.

15. A foam product comprising:

a foam core including a tightly packed cluster of expanded beads, each of the expanded beads being made of a pre-expanded bead, the foam core having a top surface on which some outermost beads of the expanded beads are exposed and protruded;

an upper foam skin with a bottom surface bonded to the top surface of the foam core, wherein the upper foam skin has at its bottom surface a plurality of cavities sized and shaped to respectively receive the protruded, outermost beads on the top surface of the foam core;

a lower foam skin with a top surface bonded to a bottom surface of the foam core;

a non-foam plastic film with a bottom surface bonded to the top surface of the upper foam skin; and a non-foam plastic plate with a top surface bonded to a bottom surface of the lower foam skin.

16. A foam product as recited in claim 15, wherein some outermost beads of the expanded beads are exposed and protruded on the bottom surface of the foam core; and the lower foam skin has at its top surface a plurality of cavities sized and shaped to respectively receive the protruded, outermost beads on the bottom surface of the foam core.

17. The foam product as described in claim 15, wherein the foam product is one of a stand up paddle board, sit on top kayak, small sail boat, windsurf board, a snow board, and a skiing board.

* * * * *